US010840580B2

(12) United States Patent
Yen et al.

(10) Patent No.: US 10,840,580 B2
(45) Date of Patent: Nov. 17, 2020

(54) DYNAMICALLY ADJUSTED ANTENNA SYSTEM AND ANTENNA ARRAY INCLUDED THEREIN

(71) Applicant: Alpha Networks Inc., Hsinchu (TW)

(72) Inventors: Anyu Yen, Hsinchu (TW); Rong-Fa Kuo, Hsinchu (TW)

(73) Assignee: ALPHA NETWORKS INC., Hsinchu (TW)

( * ) Notice: Subject to any disclaimer, the term of this patent is extended or adjusted under 35 U.S.C. 154(b) by 0 days.

(21) Appl. No.: 16/527,320

(22) Filed: Jul. 31, 2019

(65) Prior Publication Data

US 2020/0076047 A1 Mar. 5, 2020

(30) Foreign Application Priority Data

Sep. 4, 2018 (TW) ..... 107130906 A

(51) Int. Cl.
*H01Q 1/08* (2006.01)
*H01Q 21/06* (2006.01)

(52) U.S. Cl.
CPC ..... *H01Q 1/084* (2013.01); *H01Q 21/065* (2013.01)

(58) Field of Classification Search
CPC ..... H01Q 1/084; H01Q 1/38; H01Q 1/085; H01Q 1/50; H01Q 1/3291; H01Q 1/3266; H01Q 21/065; H01Q 21/29; H01Q 21/061; H01Q 3/02
See application file for complete search history.

(56) References Cited

U.S. PATENT DOCUMENTS

| | | | |
|---|---|---|---|
| 6,885,345 | B2 | 4/2005 | Jackson |
| 8,033,836 | B1 | 10/2011 | Bhakta |
| 10,027,014 | B2 | 7/2018 | Kim et al. |
| 2002/0024468 | A1 | 2/2002 | Palmer et al. |
| 2010/0168727 | A1 | 7/2010 | Hancock et al. |
| 2012/0235881 | A1 | 9/2012 | Pan et al. |
| 2014/0266973 | A1 | 9/2014 | Devries |

(Continued)

FOREIGN PATENT DOCUMENTS

| | | |
|---|---|---|
| CN | 101553181 A | 10/2009 |
| CN | 107887686 | 4/2018 |
| TW | 201244255 | 11/2012 |

(Continued)

OTHER PUBLICATIONS

Taiwan Intellectual Property Office, "Office action", dated Aug. 23, 2019.

(Continued)

*Primary Examiner* — Seokjin Kim
(74) *Attorney, Agent, or Firm* — WPAT, PC

(57) ABSTRACT

An antenna system includes an antenna array, a control device and a driving mechanism. The antenna array includes a plurality of antenna units disposed on a flexible substrate, wherein a configuration of the flexible substrate is variable so as to change relative positions of at least two of the antenna units. The control device determines the configuration of the flexible substrate according to a default setting or in response to a dynamic input. The driving mechanism is connected between the flexible substrate and the control device for driving the change of the configuration of the flexible substrate in response to a command from the control device.

6 Claims, 5 Drawing Sheets

(56) References Cited

U.S. PATENT DOCUMENTS

| | | | | |
|---|---|---|---|---|
| 2016/0197411 | A1 | 7/2016 | Subbaraman et al. | |
| 2019/0207323 | A1 * | 7/2019 | Joung, II ..... | H01Q 1/526 |

FOREIGN PATENT DOCUMENTS

| | | |
|---|---|---|
| WO | 2009012361 | 1/2009 |
| WO | 2011052238 | 5/2011 |
| WO | WO2016055130 A1 * | 4/2016 |

OTHER PUBLICATIONS

European Patent Office , "European search report", dated Nov. 25, 2019.
SIPO "Office Action" dated Sep. 2, 2020, China.

* cited by examiner

DYNAMICALLY ADJUSTED ANTENNA SYSTEM AND ANTENNA ARRAY INCLUDED THEREIN

FIELD OF THE INVENTION

The present invention relates to an antenna system, and more particular to an antenna system including an antenna array, whose conditions can be dynamically adjusted.

BACKGROUND OF THE INVENTION

In many applications, a directional antenna array is often used for sensing the specific directional state of the external environment. For example, a directional array antenna can be used to sense the surrounding obstacles appearing in the specific direction in the driving route of a car.

A directional antenna array generally includes a plurality of antennas allocated in a specified manner and combined as an antenna assembly having an overall beam direction associated with respective electromagnetic waves of the antenna units. The circuit board for mounting thereon the antenna units is usually a multilayer printed circuit board (PCB), which is advantageous in stabilizing the overall beam direction of the antenna array due to its stable and non-deformable natures. On the other hand, just because of the stable and non-deformable natures of the multilayer printed circuit board, the beam direction of the antenna array is fixed, and thus the coverage range of the beam is confined. The limited coverage range also means the limited applications, and the structure of antenna arrays would need to be particularly designed in order to properly adjust the coverage range and make better sensing performance.

SUMMARY OF THE INVENTION

Therefore, the present invention provides an antenna system includes an antenna array, a control device and a driving mechanism. The antenna array includes a plurality of antenna units disposed on a flexible substrate, wherein a configuration of the flexible substrate is variable so as to change relative positions of at least two of the antenna units. The control device determines the configuration of the flexible substrate according to a default setting or in response to a dynamic input. The driving mechanism is connected between the flexible substrate and the control device for driving the change of the configuration of the flexible substrate in response to a command from the control device.

In another aspect of the present invention, an antenna array comprises: at least first and second antenna units; a signal transmission line for connecting and delivering a signal between the first and second antenna units; and a flexible substrate, in which at least first and second antenna installation regions are defined for supporting at least the first and second antenna units, respectively, and a connecting region disposed between the first and second antenna installation regions for supporting at least the signal transmission line, wherein a substrate portion in each of the first and second antenna installation regions includes at least two layers stacking in sequence, and a substrate portion in the connecting region is configured to be flexible so that the substrate portion in the first antenna installation region and the substrate portion in the second antenna installation region are dynamically movable relative to each other.

In an embodiment, a specified one of the at least two layers of the substrate portion in each of the first and second antenna installation regions and the substrate portion in the connecting region are made of flexible material and interconnected as a continuous layer.

In an embodiment, the substrate portion in each of the first and second antenna installation regions is implemented with a multilayer printed circuit board.

In an embodiment, the substrate portion in the connecting region is implemented with single or multiple dielectric layers.

BRIEF DESCRIPTION OF THE DRAWINGS

The invention will become more readily apparent to those ordinarily skilled in the art after reviewing the following detailed description and accompanying drawings, in which.

DETAILED DESCRIPTION OF PREFERRED EMBODIMENTS

The invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1A:
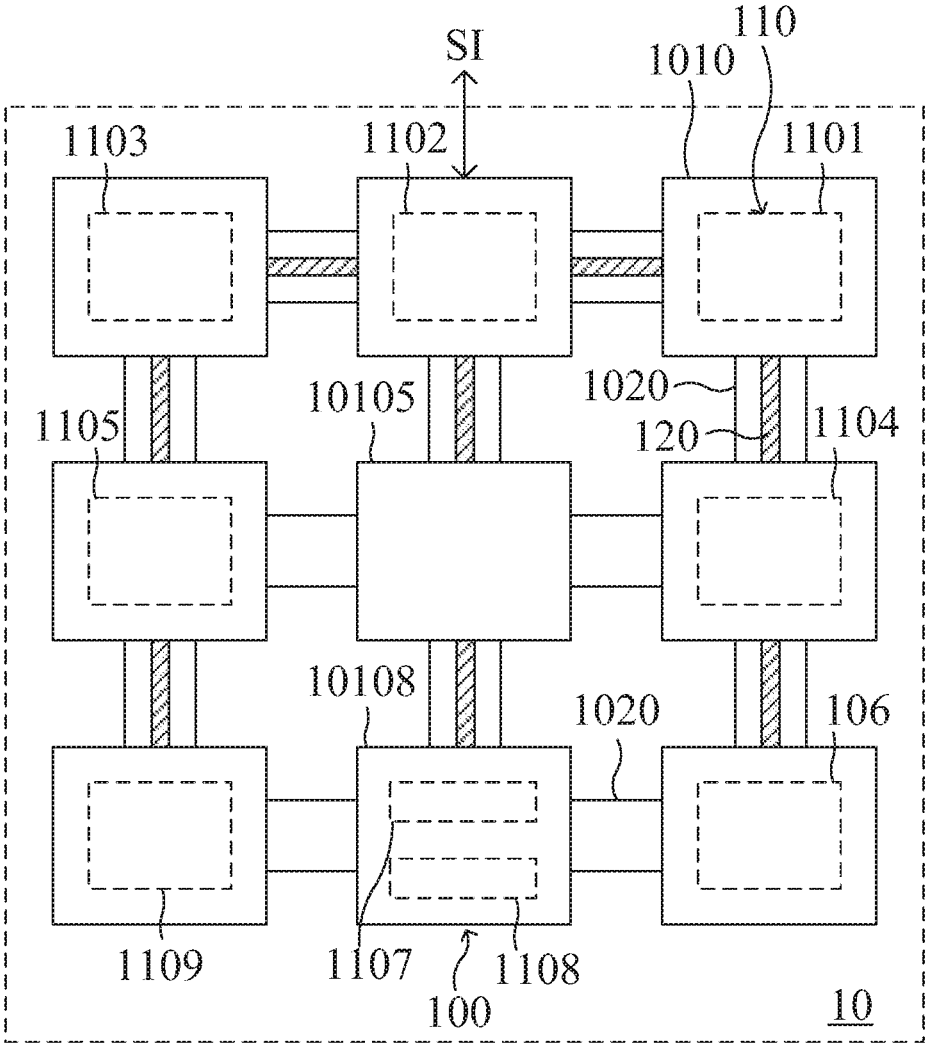
FIG. 1A is a schematic diagram illustrating an antenna array according to an embodiment of the present invention.

Please refer to FIG. 1A, which schematically shows the configuration of an antenna array according to an embodiment of the invention. As shown, the antenna array 10 includes an antenna substrate 100, antenna units 110, and signal transmission lines 120. The antenna substrate 100 is defined with two or more antenna installation regions 1010 and a corresponding number of connecting regions 1020, which interconnect the antenna installation regions 1010 in a flexible manner. The portion of the antenna substrate 100, where the connecting regions 1020 are located, is locally deformable or bendable, thereby making the connecting regions 1020 flexible. The antenna units 110 includes a plurality of antenna units 1101, 1102 . . . 1109 disposed in the antenna installation regions 1010, and each of the signal transmission lines 120 is disposed in one of the connecting regions 1020. Basically, each of the connecting regions 1020 is disposed for connecting two antenna installation regions 1010. The layout of the antenna installation regions 1010 and the connecting regions 1020 are specifically designed so that a signal SI coupled to the antenna array can be delivered among any of the antenna units 110 included in the antenna array 10 via conductive wires, which include the conductive wires in the antenna units and other conductive wires in the antenna installation regions 1010, and the signal transmission lines 120. The antenna array 10 can thus generate a certain pattern of electromagnetic wave field corresponding to the input signal SI, for communication or detection of the state of the surrounding environment accordingly. On the other hand, a signal from any of the antenna units 110 can also be transmitted out of the antenna array via the conductive wires.

Figure 1B:
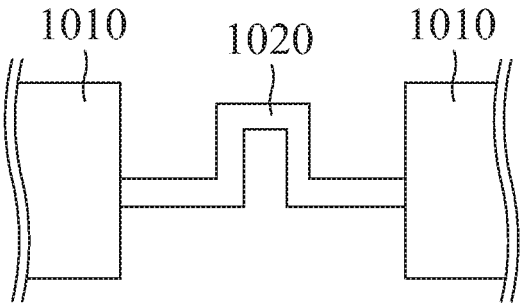
FIG. 1B is a schematic diagram illustrating partially an antenna array according to another embodiment of the present invention.

It is to be noted that the signal transmission lines 120, although expressed as straight lines in FIG. 1A, may be configured to be another shape. For example, it may be consistent battlement-shaped, as illustrated in FIG. 1B, polygon-shaped or curve-shaped. Furthermore, as the design requirement of the antenna array 10 changes, e.g. the pattern of the electromagnetic wave field changes, it is feasible to install two of the antenna units 110, e.g. the antenna units 1107 and 1108, in the same antenna installation region 1010, e.g. the antenna installation region 10108, while having one of the antenna installation regions 1010, e.g. the antenna installation region 10105, vacant without any antenna unit 110 installed therein. Likewise, as long as signals can be successfully transmitted to each of the designated antenna units 110, the connecting regions 1020 may be selectively and optionally used for disposing the signal transmission lines 120. Furthermore, the width of one or each of the connecting regions 1020 may be the same as or narrower than the width of one or each of the antenna installation regions 1010. The configuration of the antenna array 10 shown in FIG. 1 is only one implementing example of the present invention, and it is not intended to limit the applications of the present invention to the illustrated example.

Figure 2:
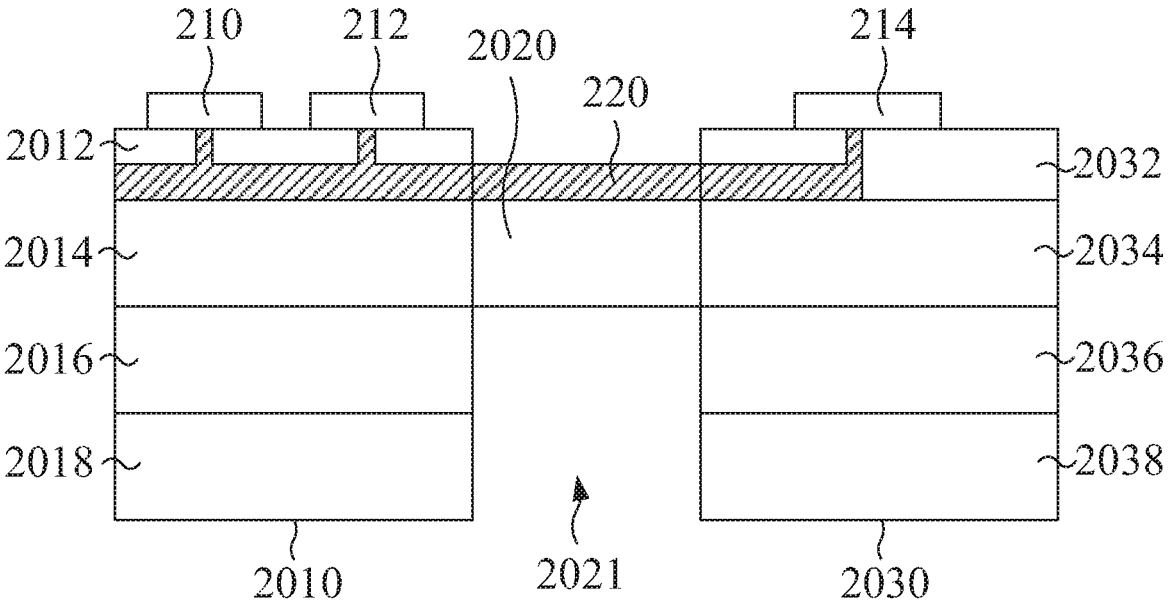
FIG. 2 is a schematic cross-sectional view illustrating a partial antenna array according to another embodiment of the present invention.

Next, please refer to FIG. 2, which is a cross-sectional view schematically exemplifying the disposition of the antenna units and signal transmission lines on the substrate and the stackup of the substrate. In the embodiment shown in FIG. 2, three antenna units 210, 212 and 214 or more are included, wherein the antenna units 210 and 212 are disposed in the same antenna installation region 2010, and the antenna unit 214 is disposed in another antenna installation region 2030. The portion of the antenna substrate 100 defined with each of the antenna installation regions 2010 and 2030 is made of a four-layer printed circuit board. For example, four separate layers 2012, 2014, 2016 and 2018 are stacked in sequence to form the printed circuit board in the antenna installation region 2010, and four separate layers 2032, 2034, 2036 and 2038 are stacked in sequence to form the printed circuit board antenna installation region 2030. For forming some of these layers, e.g. the inner layers 2014, 2016, 2034 and 2036, a dielectric material having relatively flexible and electrically insulating properties may be properly used, and for some other layers, e.g. the outer layers 2012, 2018, 2032, and 2038, a relatively rigid and non-deformable insulating material may be properly used. Moreover, the portion of the antenna substrate, where the signal transmission line 220 is located, forms a flexible or bendable layer 2020. With the above-described specific allocation and distribution of flexible and rigid material, parts of the antenna substrate 100 are inflexible while the overall antenna substrate 100 exhibits a flexible state.

In this embodiment, the antenna units 210 and 212 are disposed on the surface of the uppermost layer 2012 in the antenna installation region 2010, and the antenna unit 214 is disposed on the uppermost layer 2032 in the antenna installation region 2030. A signal transmission line 220 that transmits signals among the antenna units 210, 212, and 214 is extensively disposed on the surfaces of the layers 2014, 2020 and 2034, and is electrically coupled to the antenna units 210, 212, and 214. The layers 2014, 2020 and 2034 may, but not necessarily, be made of the same flexible material to form a continuous layer and may also be produced in the same process so that integrity among the units can be enhanced and to avoid cracks. In other words, since the layers 2014 and 2034 are made of soft material, one or both of them may extend outside the antenna installation regions 2010 and/or 2030 to serve as the flexible or bendable layer 2020, or the flexible or bendable layer 2020 may extend into the antenna installation regions 2010 and/or 2030 to function like the layers 2014 and/or 2034. The smaller thickness of the layer 2020 than the overall thickness of the composite layers in the antenna installation region 2010 or 2030 facilitates flexibility of the entire structure, and also provides a space 2021 thereunder for accommodating a flexible or bendable shift from a substrate portion from the antenna installation regions 2010 and/or 2030.

Figure 5:
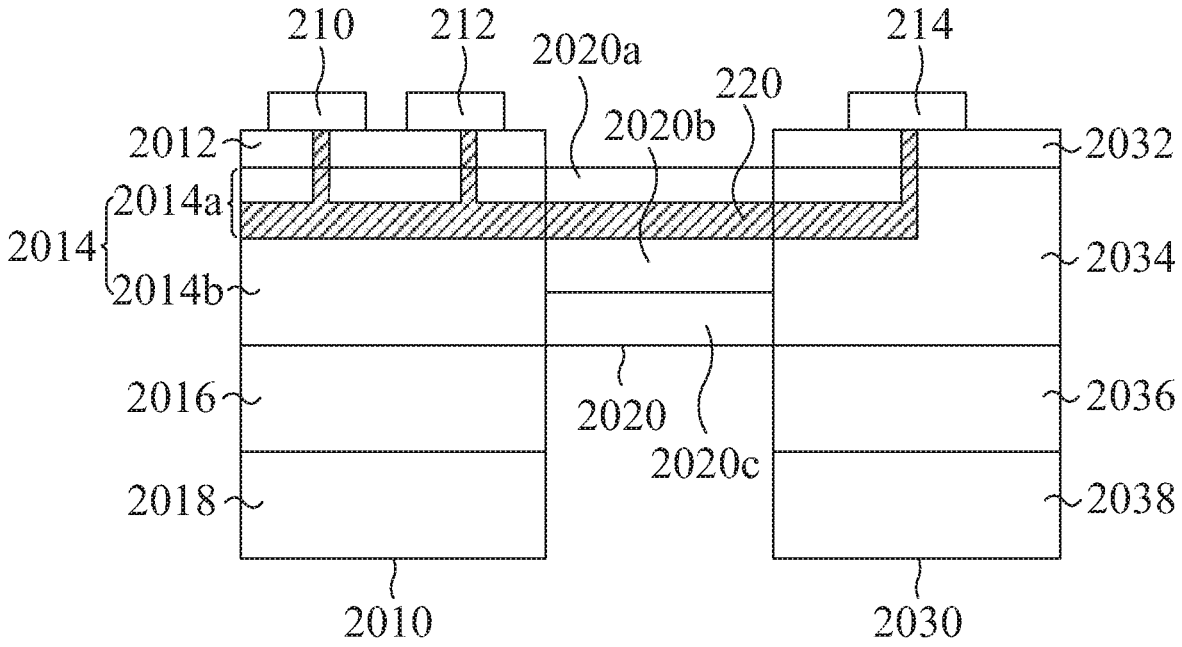
FIG. 5 is a schematic cross-sectional view illustrating a partial antenna array according to a further embodiment of the present invention.

It should be noted that the substrate portions in both the antenna installation regions 2010 and 2030 are a multilayer printed circuit board including two or more layers in the above embodiments. Alternatively, the substrate portions in the antenna installation regions 2010 and 2030 may have different configurations. For example, they may have different numbers of layers, varying with different practical requirements. Likewise, although the substrate portion in the connecting region is a single layer, the flexible or bendable layer 2020 may also be designed to include multiple layers 2020*a*, 2020*b* and 2020*c* of dielectric material, if practically required, as illustrated in FIG. 5. In the embodiment shown in FIG. 2, the signal transmission line 220 is disposed within the layers 2014, 2020 and 2034. In the embodiment as shown FIG. 5, the signal transmission line 220 is disposed on the layer 2020*b* and covered by the layer 2020*a*. As shown in FIG. 5, the layer 2014 further includes two sub-layers 2014*a* and 2014*b*, and the signal transmission line 220 is disposed on the layer 2014*b* and covered by the layer 2014*a*.

Figure 3:
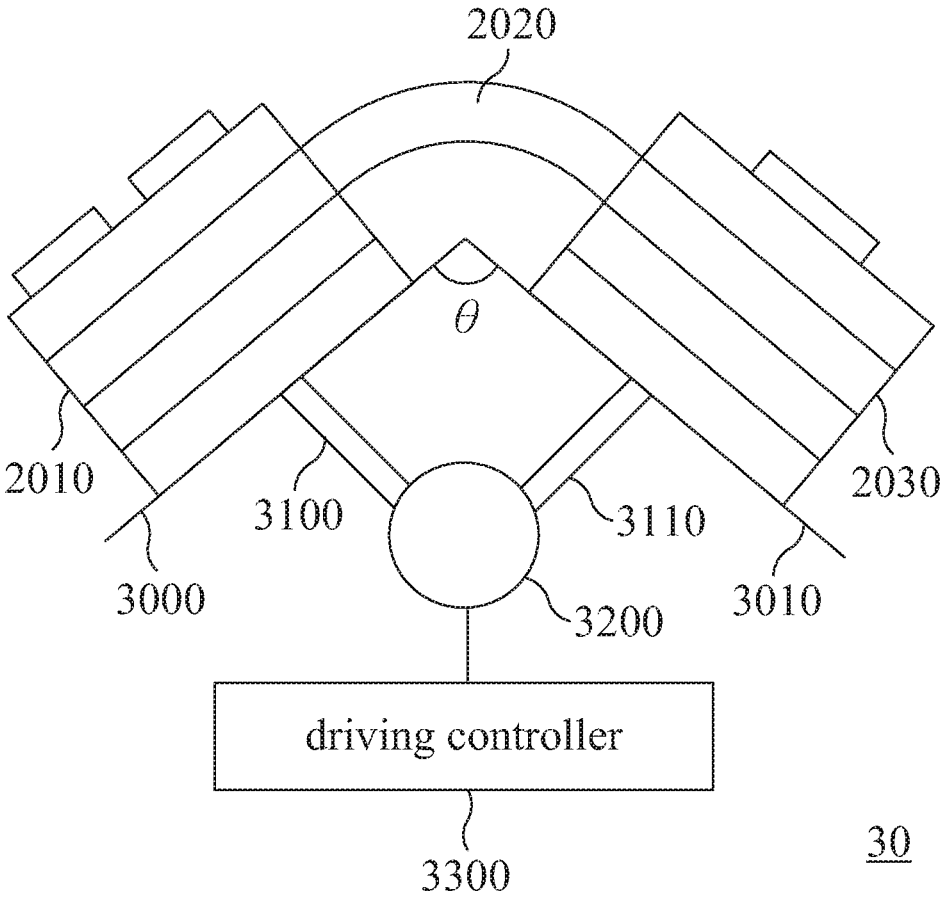
FIG. 3 is a schematic diagram illustrating a systematic structure of an antenna system including the antenna array of FIG. 2.
Figure 4:
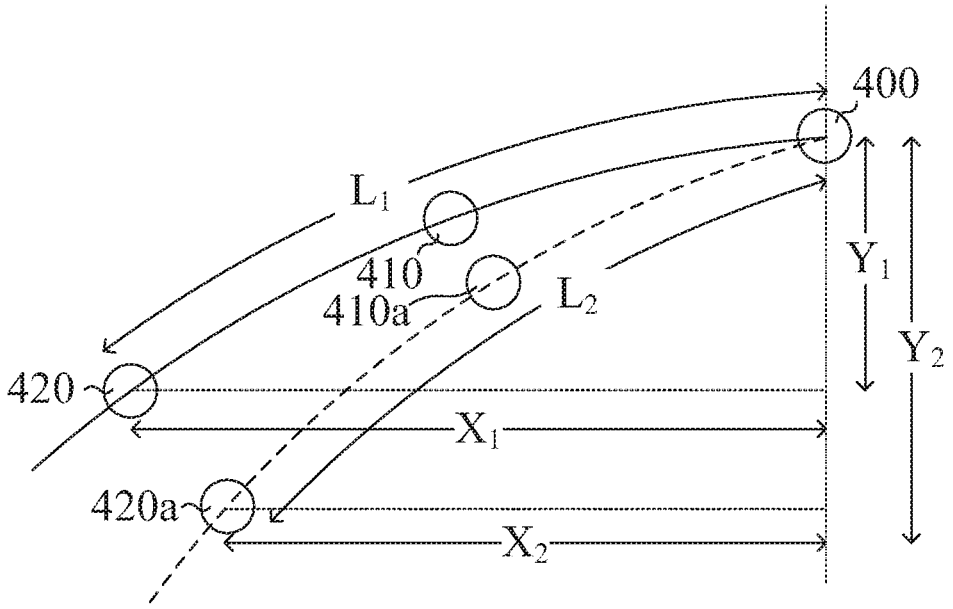
FIG. 4 is a scheme illustrating an initial state and a bending state of the antenna array in the antenna system of FIG. 3.

Next, please refer to FIG. 3, which is a schematic diagram of a system architecture of an antenna system according to an embodiment of the invention. The antenna system 30 in this embodiment includes the antenna array shown in FIG. 2 and is equipped with a control device composed of a supporting frame including supporting segments 3000 and 3010, a driving structure including driving rods 3100 and 3110 and a servo motor 3200, and a driving controller 3300. With the configuration as shown, an effect of changing positions of the antenna array and adjusting bending degrees of the flexible substrate according to a control command can be achieved. In an embodiment, the control command may be automatically generated and provided for the driving controller 3300 by deep sensing learning in response to a sensing result of a sensing device, which is included in or external to the antenna system. For example, a motion sensor such as a passive infrared (PIR) sensor or a radar sensor senses data of a target angle and/or other motional parameters of an object in the detected region where the antenna system 30 is disposed and conducts a monitoring operation. Then the data of the target angle and/or motional parameters of the object is outputted to the driving controller 3300, and the driving controller 3300 determines how the state of the antenna array is to be changed according to the sensing result. Then the driving controller 3300 issues a control command to have the servo motor 3200 drives the supporting frame 3000 to bend via the driving rods 3100 and/or 3110, thereby adjusting a configuration of the antenna array, e.g. relative positions of the antenna units included in the antenna array. FIG. 4 schematically illustrates an initial state and a bending state of the antenna array, in which the circles 400, 410, and 420 represent the relative positions of the three antenna units 210, 212 and 214. The scheme in FIG. 4 shows that in the initial state, the positions 400 and 420 are different and horizontally apart from each other with a distance X1, and different and vertically apart from each other with a distance Y1. As shown in the figure, the length L1 is the length of the signal transmission line 220 between the positions 400 and 420, wherein the signal transmission line 220 interconnects the three antenna units 210, 212 and 214. When adjustment of the state of the antenna array is required, the location of the antenna units of the antenna array is adjusted by the servo motor 3200. As shown, the antenna unit 210 is originally located at the position 400. It is to be noted that the position 400 is not necessarily a fixed location, and it may be variable in other applications. The driving controller 3300 controls the servo motor 3200 to respectively move the locations of the antenna units 212 and 214 from the original positions 410 and 420 to the positions 410*a* and 420*a* as respectively shown in FIG. 4. Since the length L2 of the signal transmission line, after being adjusted, will not change and is still equal to the length L1. Accordingly, the horizontal distance between the positions 400 and 420*a* changes from X1 to X2, and the vertical distance between the positions 400 and 420*a* changes from Y1 to Y2. As a result, the pattern of the electromagnetic wave field derived from the three antenna units can be adjusted by changing the relative positions of the associated antenna units.

In this embodiment, each of the supporting segment 3000 and 3010 is relatively rigid to maintain a fixed shape, e.g. a planar shape. The supporting segment 3000 can be used to secure the structure in the antenna installation region 2010, and the supporting segment 3010 can be used to fix the structure in the antenna installation region 2030. The driving rod 3100 is coupled to the supporting segment 3000 and the servo motor 3200, and transmitted to adjust the position of the supporting segment 3000 by the servo motor 3200. Likewise, the driving rod 3110 is coupled to the supporting segment 3010 and the servo motor 3200, and transmitted to adjust the position of the supporting segment 3010 by the servo motor 3200. The driving controller 3300 is electrically coupled to the servo motor 3200, and controls the operation of the servo motor 3200 according to preset or dynamically inputted conditions, thereby controlling the motions of the driving rods 3100 and 3110. With the movement of the driving rods 3100 and 3110, the positions of the supporting segments 3000 and 3010, and the angle Θ between the supporting segments 3000 and 3010 will change, so as to change the relative positions of the antenna units 210, 212, and 214. Accordingly, the electromagnetic wave field pattern along with the emitted electromagnetic waves will change as well. In this way, the layout of the antenna array can be flexibly designed and the relative positions of the array units in the antenna array can be dynamically adjusted to create desired patterns of electromagnetic wave field.

The present invention may involve in a variety of applications in our daily lives. For example, safety of a car equipped with headlights rotating with its steering wheel may be further enhanced by installing an antenna array according to the present invention on the lamp holders of the headlights or any other suitable place where antenna detection is required. The configuration of the antenna array can be synchronously determined and adjusted according to the directional rotating degrees of the steering wheel or the headlight(s) to realize more reliable information for driving safety. In another example, an antenna array according to the present invention may be disposed on one or more gravity sensors (G sensors) in rearview mirrors of a car to provide important driving information for the driver. The antenna array according to the present invention may also be used in a camera for detecting or compensating a focus shift problem.

In view of the foregoing, by installing antenna units on a flexible substrate to form an antenna array, a configuration of the antenna array, e.g. relative positions of the antenna units included in the antenna array, can be dynamically and finely adjusted to provide a desirable configuration of the antenna array for some specific purpose. The adjustment of the relative positions of the antenna units can be readily achieved as a result of a relative motion between portions of the flexible substrate in response a default setting or a dynamic input command. Furthermore, a substrate can be made flexible by a variety of ways. For example, it can be accomplished by way of selected material and/or structural design.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An antenna array, comprising:

at least first and second antenna units;

a signal transmission line for connecting and delivering a signal between the first and second antenna units; and a flexible substrate, in which at least first and second antenna installation regions are defined for supporting at least the first and second antenna units, respectively, and a connecting region disposed between the first and second antenna installation regions is defined for supporting at least the signal transmission line, wherein a substrate portion in each of the first and second antenna installation regions includes multiple layers stacking in sequence, and at least an inner one of the multiple layers extends through the substrate portion in the first antenna installation region, the substrate portion in the second antenna installation region and a substrate portion in the connecting region as a continuous layer, and is configured to be flexible so that the substrate portion in the first antenna installation region and the substrate portion in the second antenna installation region are dynamically movable relative to each other, while a length of the substrate portion in the connecting region between the first and second antenna installation regions is kept substantially constant during the dynamic movement, and wherein the substrate portion in the connecting region is thinner than the substrate portion in each of the first and second antenna installation regions so as to remain a space under the substrate portion in the connecting region between the substrate portions in the first and second antenna installation regions.

2. The antenna array according to claim 1, wherein an outer one of the multiple layers of the substrate portion in each of the first and second antenna installation regions for installing thereon the first/second antenna unit is made of less flexible material than the inner one of the multiple layers.

3. The antenna array according to claim 1, further comprising a third antenna unit supported by the same substrate portion in the first or second antenna installation region, and interconnected with the first and second antenna units by the signal transmission line.

4. The antenna array according to claim 1, wherein the substrate portion in each of the first and second antenna installation regions is implemented with a multilayer printed circuit board.

5. The antenna array according to claim 1, wherein the substrate portion in the connecting region is implemented with single or multiple dielectric layers.

6. An antenna system, comprising:

the antenna array as claimed in claim 1;

a control device determining a relative motion between the substrate portion in the first antenna installation region and the substrate portion in the second antenna installation region according to a default setting or in response to a dynamic input; and a driving mechanism connected to the substrate portions in the first and second antenna installation regions and the control device for driving the relative motion in response to a command from the control device.

* * * * *